US006634323B2

(12) United States Patent
Vaudry et al.

(10) Patent No.: US 6,634,323 B2
(45) Date of Patent: Oct. 21, 2003

(54) COOLING UNITS FOR MOTOR VEHICLES

(75) Inventors: Jean-Paul Vaudry, Sigolsheim (FR); Richard Komurian, Turckheim (FR); Anthony Alves, Holtzwihr (FR)

(73) Assignee: Mark IV Systemes Moteurs (Société Anonyme), Courbevoie (FR)

( * ) Notice: Subject to any disclaimer, the term of this patent is extended or adjusted under 35 U.S.C. 154(b) by 0 days.

(21) Appl. No.: 10/029,644

(22) Filed: Oct. 25, 2001

(65) Prior Publication Data

US 2002/0121554 A1 Sep. 5, 2002

(30) Foreign Application Priority Data

Oct. 27, 2000 (FR) ..... 00 13844

(51) Int. Cl.[7] ..... F01P 7/14
(52) U.S. Cl. ..... 123/41.1
(58) Field of Search ..... 123/41.1, 41.44, 123/41.49

(56) References Cited

U.S. PATENT DOCUMENTS 4,913,107 A * 4/1990 Schweiger ..... 123/41.54
5,660,149 A 8/1997 Lakerdas et al.
6,047,895 A 4/2000 Pastleitner et al.

FOREIGN PATENT DOCUMENTS

| | | | |
|---|---|---|---|
| EP | 0301959 | 2/1989 | ..... F01P/7/16 |
| EP | 0584850 | 3/1994 | ..... F01P/5/10 |
| EP | 0894953 | 2/1999 | ..... F01P/7/16 |
| EP | 0969189 | 1/2000 | ..... F01P/7/16 |

* cited by examiner

*Primary Examiner*—Tony M. Argenbright
*Assistant Examiner*—Katrina B. Harris
(74) *Attorney, Agent, or Firm*—Chapman and Cutler LLP

(57) ABSTRACT

The present invention relates to a water-type cooling unit for a vehicle equipped with an internal-combustion engine, the unit being connected via a main circulation loop formed by appropriate conduits, in particular to at least one radiator for cooling the water or the similar coolant and to the circuits for cooling the cylinder block and the cylinder heads.

Unit, characterized in that it comprises a central module in the form of a body made of thermoplastic material in which there are, in particular, mounted or partially molded a water-circulating pump and a flow-regulating valve disposed in the circulating loop, preferably between the aforementioned cooling circuits and the radiator.

19 Claims, 7 Drawing Sheets

6''''
6'''
14'
6
10
11'
toward 4
2
10
11
2
14
2
toward 6
9
12
12'
5
10
toward 3
from 4
2
2
7

8
Toward 4,4'
Toward 13
toward unit heater
From 3
From 4,4'
2
6
6'''
6''''
11'
10'
10''
12'
9''
12
11
12
11'
10
14'
14
2
9
9
7

COOLING UNITS FOR MOTOR VEHICLES

The present invention relates to the field of vehicles equipped with a heat engine or internal-combustion engine, more particularly to the various cooling and heating functions carried out in these vehicles and concerns a cooling unit or device for such a vehicle.

BACKGROUND OF THE INVENTION

At present, the various components and exchangers used in thermal exchanges in such a vehicle are generally distributed over a plurality of points round the engine and interconnected by a plurality of distinct circulating circuits, necessitating very long conduits and therefore high production and installation costs and significant losses of load.

Furthermore, this distribution of these various constituent components leads to high thermal inertia of the system and therefore long reaction times and the obligation to use a large quantity of coolant.

Moreover, the coolant is generally circulated by a pump which is driven mechanically by the heat engine and is optionally connected to regulating valves, all-or-nothing valves or the like, the flow rate thus depending directly on the engine speed and not allowing anticipation in terms of heat management or decoupled operation of said engine.

Furthermore, existing cooling systems depending directly on the engine parameters have to be designed as a function of the most punitive vehicle/engine couple.

SUMMARY OF THE INVENTION

The object of the present invention is, in particular, to overcome at least some of the aforementioned drawbacks.

For this purpose, it relates to a water-type cooling unit for a vehicle equipped with an internal-combustion engine, the unit being connected via a main circulation loop formed by appropriate conduits, in particular to at least one radiator for cooling the water or the similar coolant and to the circuits for cooling the cylinder block and the cylinder heads, characterised in that it comprises a central module in the form of a body made of thermoplastic material in which there are, in particular, mounted or partially moulded a water-circulating pump and a flow-regulating valve disposed in the circulating loop, preferably between the aforementioned cooling circuits and the radiator.

BRIEF DESCRIPTION OF THE DRAWINGS

The invention will be understood better by means of the following description which refers to preferred embodiments given as non-limiting examples and explained with reference to the accompanying schematic drawings, in which.

DETAILED DESCRIPTION OF THE INVENTION

Figure 1:
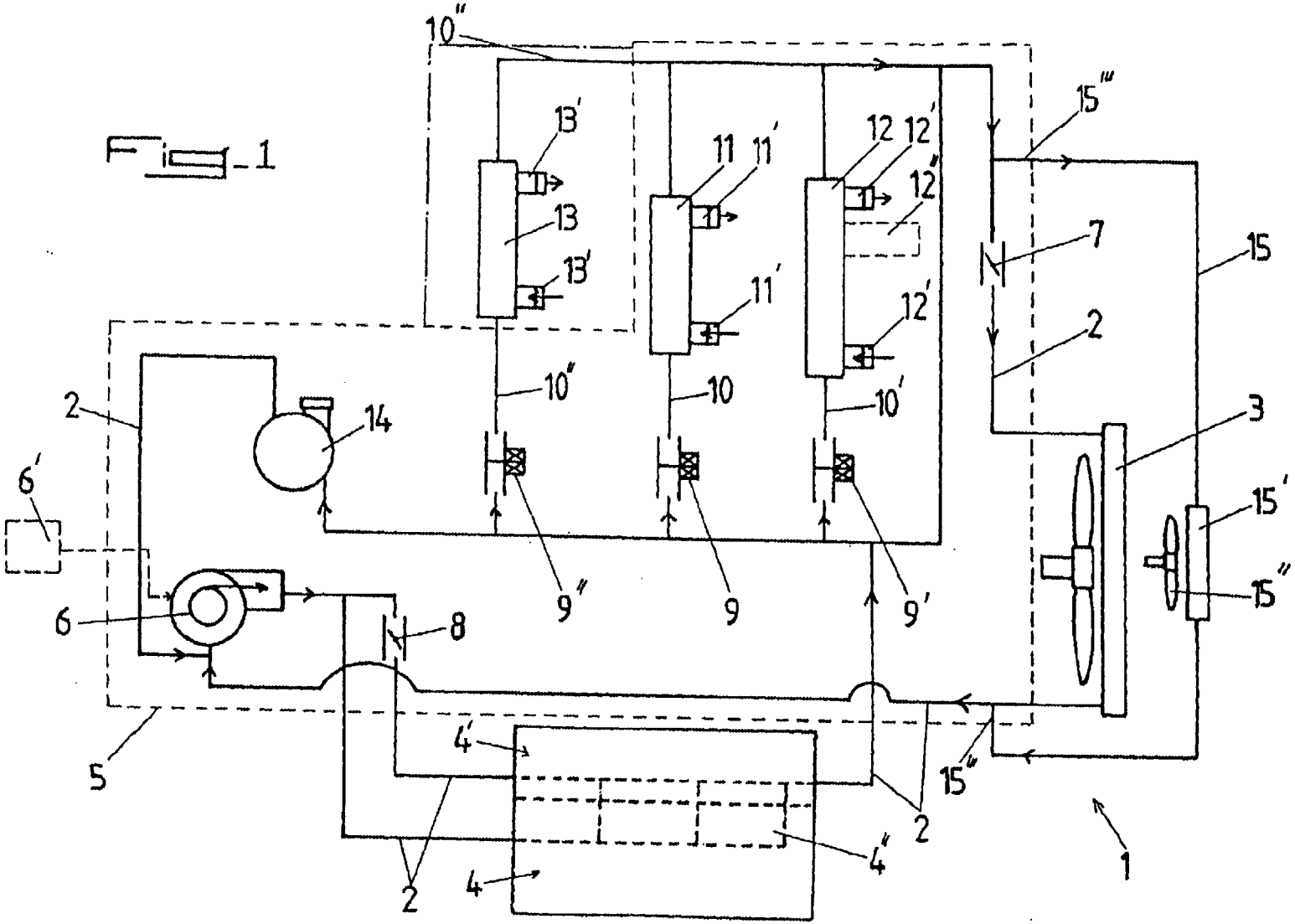
FIG. 1 is a block diagram of a cooling unit according to a first embodiment of the invention.

As shown in the figures of the accompanying drawings, the cooling unit or system 1 is connected via a main circulation loop 2 formed by appropriate conduits, in particular to at least one radiator 3 for cooling the water or the similar coolant and to the circuits for cooling the cylinder block 4 and the cylinder heads 4' of an engine 4".

According to the invention, said unit 1 comprises a central module 5 in the form of a body made of thermoplastic material in which there are, in particular, mounted or partially moulded a water-circulating pump 6 and a flow-regulating valve 7 disposed in the circulating loop 2, preferably between the aforementioned cooling circuits 4, 4' and the radiator 3.

Figure 2:
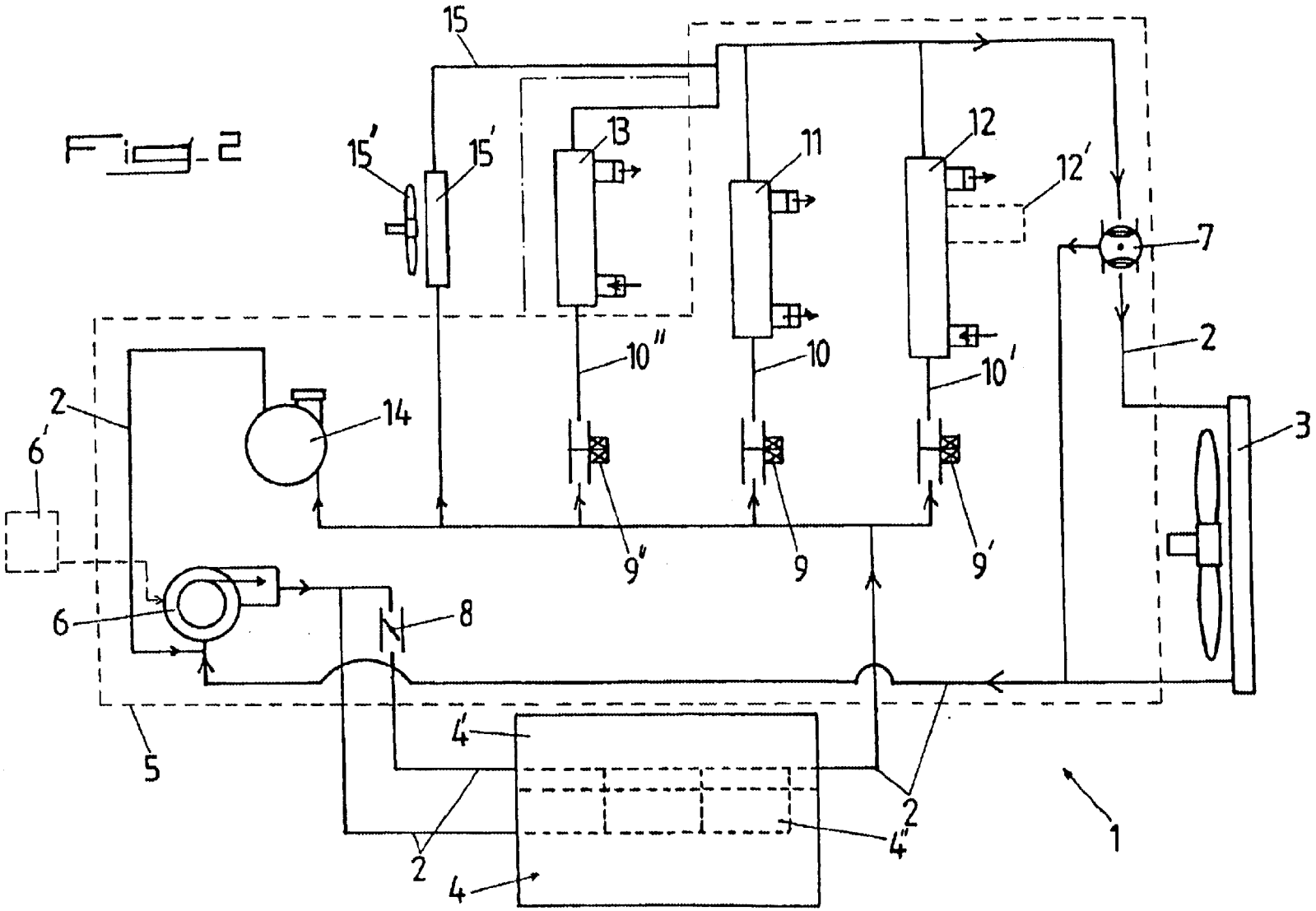
FIG. 2 is a block diagram of a cooling unit according to a second embodiment of the invention.

FIG. 1 of the accompanying drawings shows an embodiment in which the regulating valve 7 directly controls the flow of liquid passing through the radiator 3, and FIG. 2 an embodiment in which the flow is indirectly controlled by diversion of a part of the flow in a bridging circuit portion of said radiator 3 via a valve 7.

The circulating pump 6 could be driven mechanically, for example by the distribution belt, the central module 5 in this case having a sufficiently rigid structure to withstand the tensions generated.

According to a preferred embodiment of the invention, however, the circulating pump 6 consists of an electrically (electric motor 6'") driven pump, operation of which is controlled by an electronic management unit 6' connected or forming part of the management and operation-monitoring unit of the engine 4" or of the vehicle, this unit 4" providing the unit 6' with information concerning the temperature of the cylinder block and of the cylinder heads, the engine speed and load, the running parameters of the vehicle and/or the reference values and the measured values of the thermal parameters in the vehicle body region.

Alternatively, two circulating pumps could also be provided, depending on the complexity of the functions to be fulfilled by the unit 1, namely a main pump (for example mechanically driven) and a secondary pump (for example electrically driven by a brushless motor or otherwise).

According to an advantageous characteristic of the invention shown in FIGS. 1 and 2 of the accompanying drawings, in the central module 5 there are also mounted or partially moulded, on the one hand, at least one flow-regulating valve or valve part 8 mounted in the circulating loop portion 2 extending between the pump 6 and the cylinder head cooling circuit 4' and/or the cylinder block cooling circuit 4 and, on the other hand, at least one valve 9, 9', 9" or valve part, preferably of the all-or-nothing type, controlling the supply of at least one secondary branch 10, 10', 10" forming a circulating circuit portion mounted in parallel on the main circulating loop 2 and of which the flow passes through at least one liquid/liquid or liquid/gas heat exchanger 11, 12, 13.

According to a preferred variation of the invention, integrated in the structure of the central module 5 are at least one expansion tank or degasification bottle 14 and at least the external casings of a heat exchanger 11 for cooling the exhaust gases and of a heat exchanger 12 for cooling the oil from the crankcase and/or the automatic gearbox of the vehicle and optionally their connecting fittings 11', 12' and a site for fitting a filter 12" or the like.

Integrated in the structure of said module may be at least the casing of a liquid/gas heat exchanger 13 connected to a unit heater and optionally its connecting fittings 13' for connecting it to a corresponding circulating circuit for the unit heater fluid (the physical limit of the module 5 is indicated schematically in this case by mixed broken lines in the region of the exchanger 13).

Alternatively, as also shown in FIGS. 1 and 2 of the accompanying drawings, the central module 5 may incorporate only the fittings forming the beginnings of the secondary branch 10", the exchanger not being incorporated and being located at a distance from said central module 5 (the physical limit of the module is thus located in the region of the broken line with uniform dashes).

The circulation of fluid in the secondary branches 10, 10' and 10" is controlled directly by the control of the corresponding respective valves 9, 9' and 9", it is in the region of the upstream ends of said branches 10, 10' and 10".

The main circulating loop 2 can also comprise an additional secondary branch 15 supplying a second radiator 15' connected to a fan 15" intended, for example, for heating the vehicle body and mounted either in parallel on the circulating loop portion 2 incorporating the cooling radiator 3 (also connected to a fan), with a branch upstream of the flow-regulating valve 7 connected to said radiator 3, or in parallel relative to the secondary branch or branches 10, 10' or 10".

According to an advantageous embodiment of the invention leading to a compact structure, the central body 5 has a multi-layered constitution with a three-dimensional arrangement of its various constituent parts, forming a compact structure incorporating certain conduit portions of the main circulating loop 2, in particular those connecting the elements 6, 14, 11, 12, 13 forming part of central body 5 as well as at least, in the form of connecting fittings, the beginnings of the remaining portions of said main circulating loop 2, of the ramification(s) forming at least one secondary branch 10, 10', 10" forming the secondary branch(es) and/or of the liquid or gas circulating circuit(s) cooled by the heat exchanger(s) 11, 12, 13 incorporated in the structure of said central body.

Furthermore, integrated in the structure of the central module 5, are installation sites and optionally portions of walls constituting the body, the circulating pump 6, the regulating valve(s) 7, 8, the all-or-nothing valve(s) 9, 9', 9" and/or an oil filter 12".

The oil filter will advantageously be mounted or moulded in the region of the casing of the exchanger 12 (see FIGS. 1 and 2).

Referring to FIGS. 3A, 3B, 4, 5A and 5B of the accompanying drawings showing a non-limiting embodiment, the central module 5 therefore consists of a compartmentalised hollow body of which the geometric structure extends over a plurality of planes or in a plurality of levels and in a plurality of directions, and this results in great compactness, allowing easy installation of the module 5 in the immediate vicinity of the engine 4" or directly thereon.

With regard to the active or moving elements, the central module 5 could incorporate, on the one hand, wall portions of the valve bodies 7, 8 and 9 or conduit or fitting portions comprising sites for receiving closing components of such valves or measuring devices and sensors and, on the other hand, the shell 6" of the pump 6, the moving member thereof and its electric drive motor 6'" being mounted in the region of a suitable site or in a housing 6"" formed on the external casing of said shell 6" and complementary therewith.

Furthermore, the conduit portions forming the parts of the circulating loop 2 or of the secondary branches 10", 15 external to the central module 5 may be produced by injection moulding, blowing or vibration welding and may be equipped with quick couplings allowing them to be connected to the fittings 11', 12', 13, 14', 15'" forming part of central module 5.

In addition, the central module 5 can also comprise sites for fitting heat, pressure and/or flow sensors of which the measuring signals are transmitted to the management unit 6' as well as a fitting 14' formed on the expansion tank 14 for installation of a pressure-limiting valve or the like.

The valves 7, 8 and 9 can consequently act as thermostats which are controlled electrically by the unit 6' (solenoid valve) with a safety position in the event of a power failure or malfunction which allows the motor 4" to operate in downgraded mode.

According to an advantageous variation of the invention, the central module 5 consists of at least two parts obtained by injection moulding and joined together by friction or vibration welding.

Figure 3A:
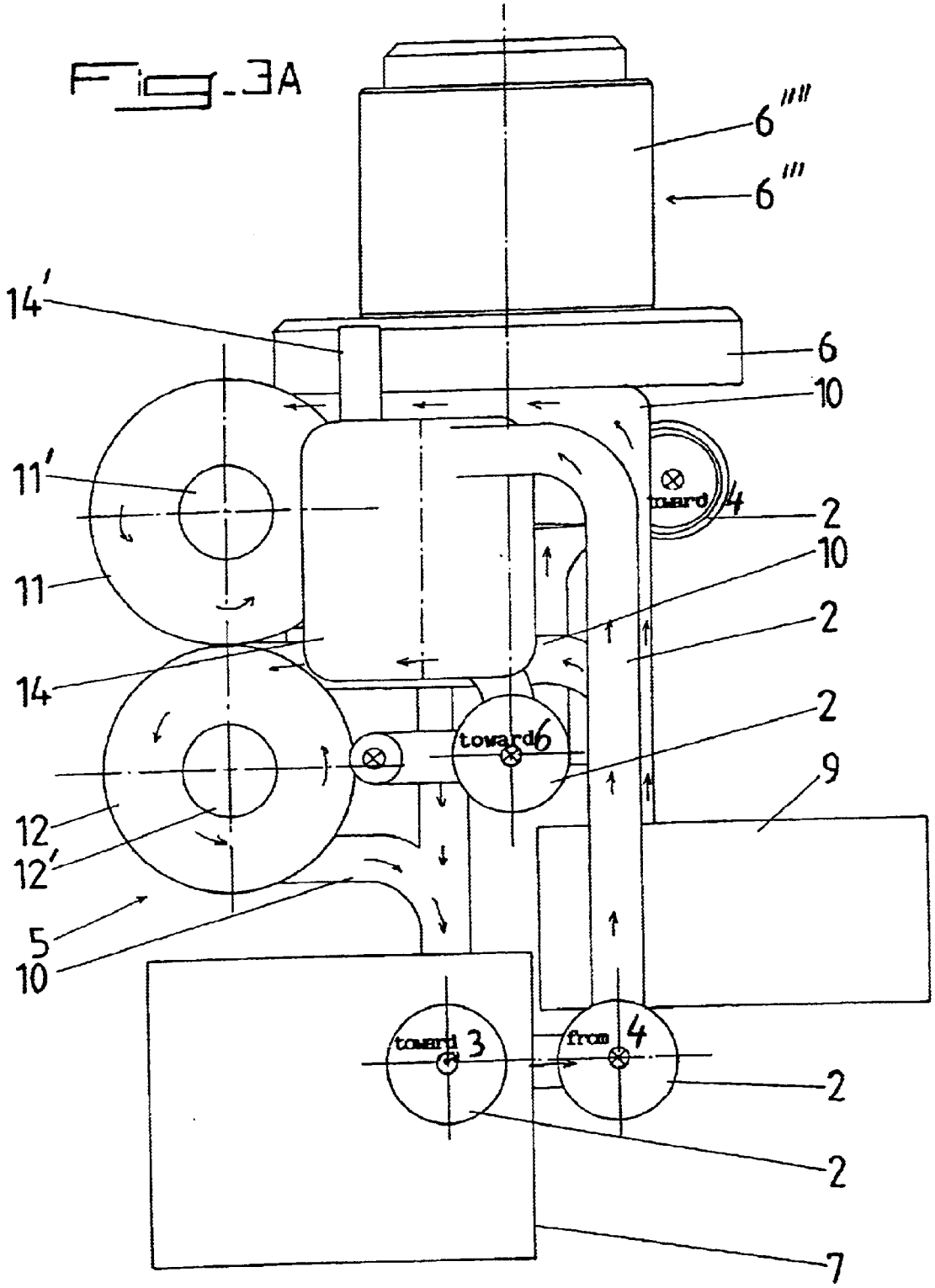
FIGS. 3A and 3B are schematic side elevations in two mutually orthogonal directions of a structure of a central module according to a variation of the cooling unit in which the directions of circulation of the fluids are indicated by transparency.
Figure 3B:
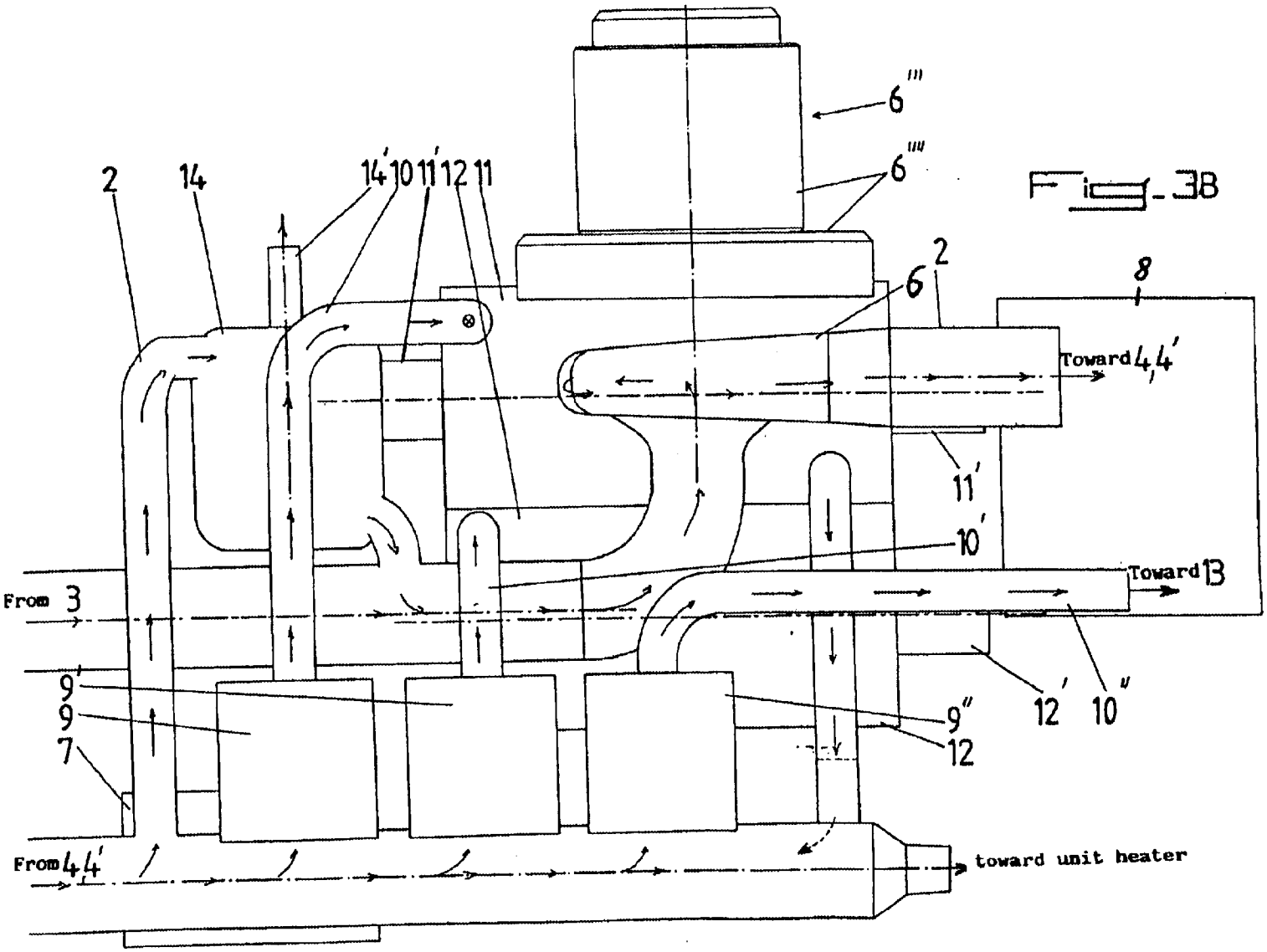
Figure 4:
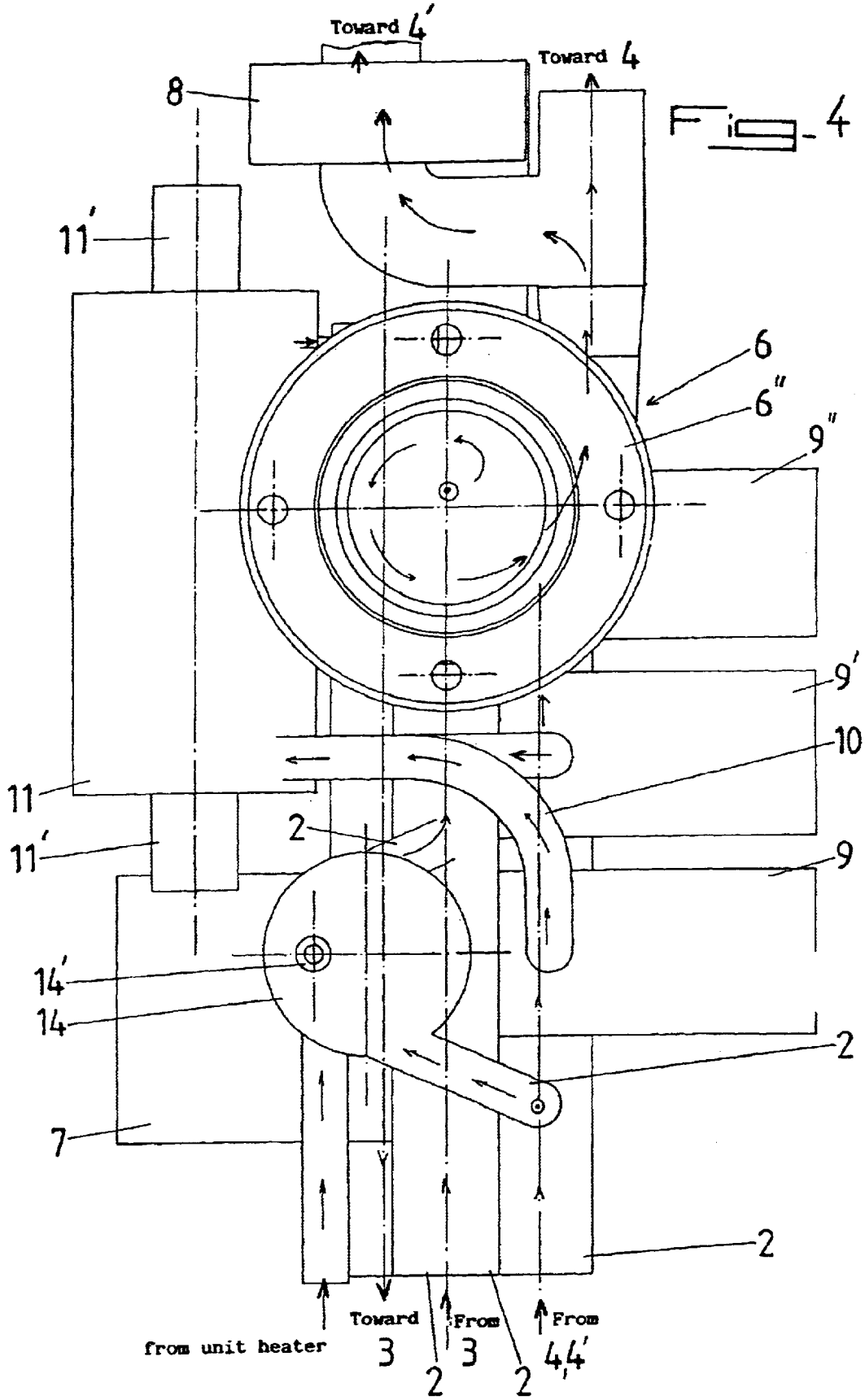
FIG. 4 is a partial plan view of the central module shown in FIGS. 3A and 3B.
Figure 5A:
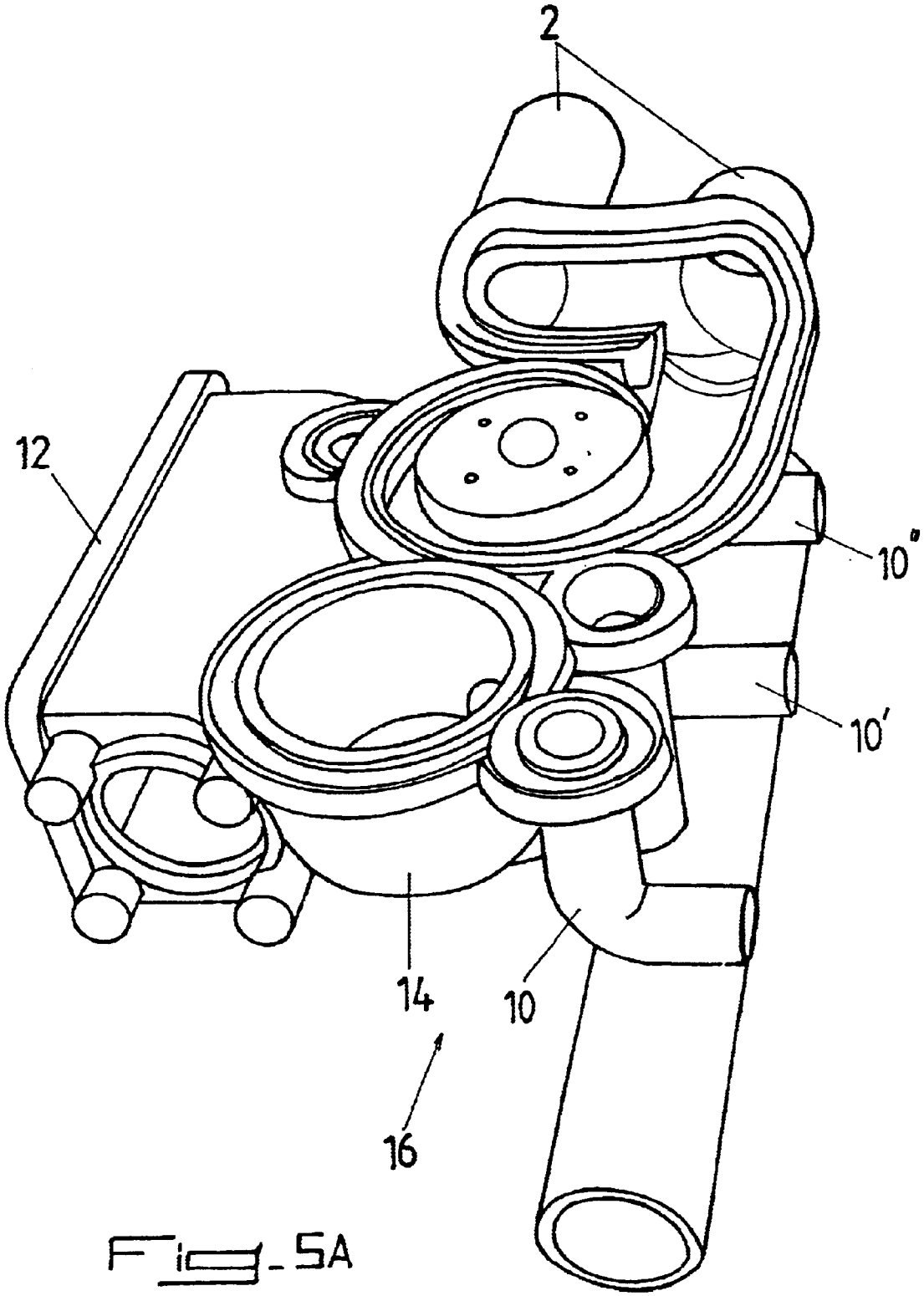
FIGS. 5A and 5B are perspective views of a respective lower part and upper part which are joined together to form the central module shown in FIGS. 3A and 3B.
Figure 5B:
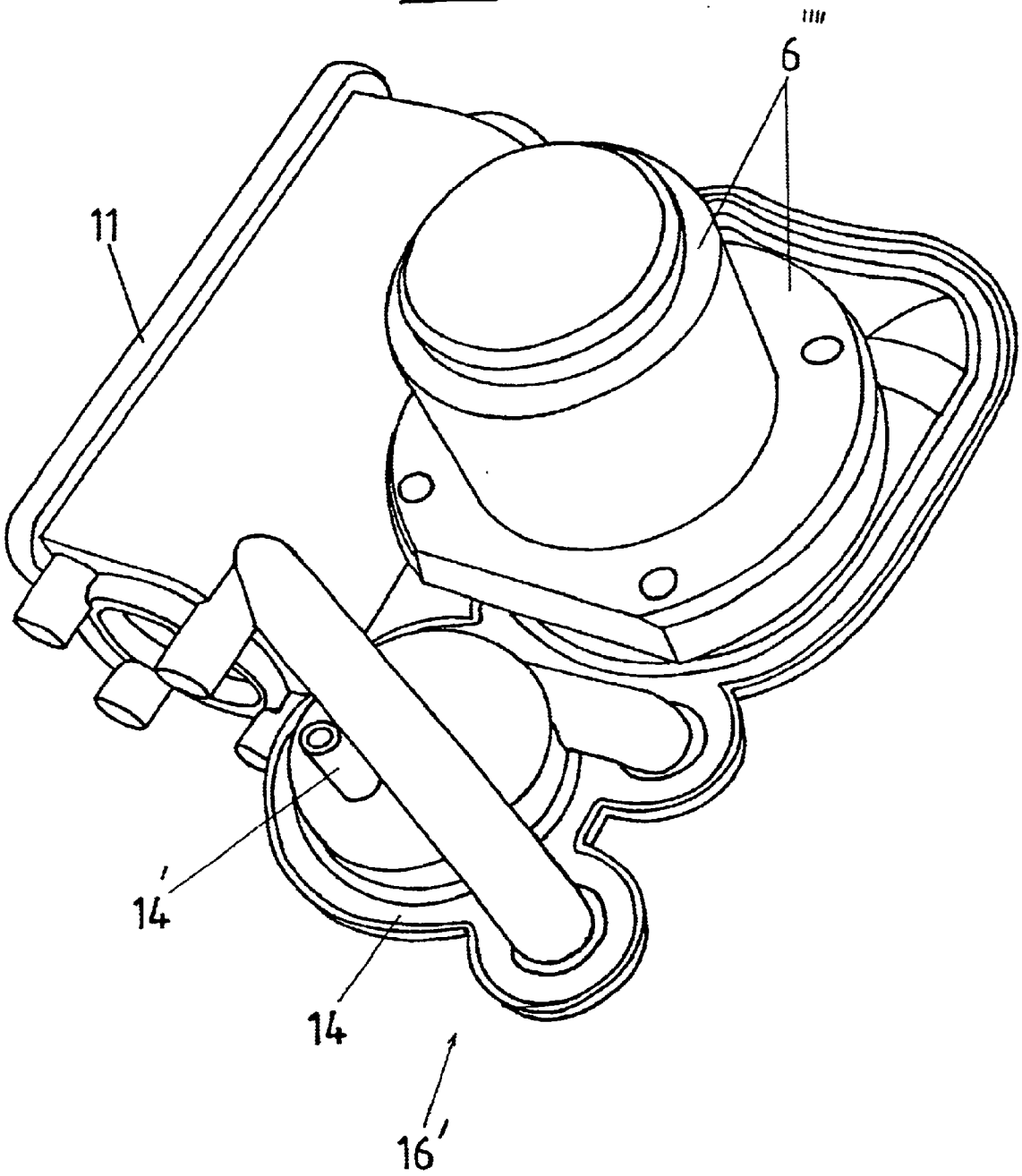

Referring to FIGS. 5A and 5B in conjunction with FIGS. 3A and 3B of the accompanying drawings, the central module 5 is preferably formed by two parts, an upper part 16 and a lower part 16' which are joined together by vibration welding.

The joint plane will be designed to lead to a simple structure for the two parts 16 and 16' which can easily be injection moulded. It will extend, in particular, through the closed volumes intended to receive the moving components (for example pump 6) or large-volume components (for example tank 14).

The cooling unit 1 proposed by the present invention combines the various functions distributed among current cooling systems (integration of functions allowing an economic saving) and provides a device which allows autonomous management of the distributions of flows of fluids and heat transfers between the various parts carrying out the thermal exchanges while limiting the losses of load and the power consumed by the active components 6, 7, 8 and 9.

Owing to its compactness, the central module 5 which combines the majority of the functional elements of the cooling unit 1 could easily be disposed in the immediate vicinity of the engine 4", and this allows the engine to be tested with its cooling circuit at the end of the assembly line, allows the volume of coolant, the number of conduits between the various heat exchanger components and the reaction time of the cooling unit (hysteresis) to be reduced and allows a saving in space by packing together of functions.

Owing to the use of a central module 5 and an electrically actuated pump 6, thermal regulation may be carried out by varying parameters such as the rating of the electric water pump (rating disconnected from the engine rating) and by the opening or closure (proportional or otherwise) of valves controlled by a particular management unit 6', therefore on the basis of criteria and actions independent of the engine parameters, which result in great flexibility in use and implementation (use of a single given central module 5 for engine range of different powers without a downgrade in the performance of each of them).

In fact, owing to the provisions of the invention, the flow rates and the losses of load are totally variable and are managed electronically with finer temperature regulation preventing thermal oscillations of great amplitude and allowing adaptation of said cooling unit 1 for each drive unit, each control strategy, each case of load variation or the like.

The cooling unit 1 may therefore be reduced in different versions adapted to different drive unit powers or models, said versions being distinguished from one another by the positioning, in a maximum capacity version, of restrictions, constrictions or chicanes with predetermined diameters or constraints as a function of the requirements of the drive units under consideration.

It is therefore possible to provide a standard central module 5 and to distinguish versions by varying the cross-sections of the passages, openings or other communicating conduits.

It is therefore also possible to provide a standard or single central module 5 and to modify the characteristics of the cooling system by adapting each drive unit by modifying the computer programme managing the various actuators of the module 5 (valves, water pump(s), regulators, etc.).

In addition to the above-described versatility and better regulation, the performance of the engine 4" is increased and the pollution generated thereby is reduced.

During a cold start, therefore, the cooling unit 1 according to the invention reduces the period required for thermal stabilisation of the engine and therefore the polluting emissions present under these operating conditions. The limitation to the thermal oscillations and the dissociation of the parameters taken into consideration from the engine parameters allow the engine to operate at a higher mean temperature and this leads to increases in power and in the performance of the engine.

The invention is obviously not limited to the embodiments described and illustrated in the accompanying drawings. Modifications are possible, in particular with regard to the constitution of the various elements or by substitution of technical equivalents, without departing from the scope of protection of the invention.

What is claimed is:

1. Water-type cooling unit for a vehicle equipped with an internal-combustion engine, the unit being connected via a main circulating loop (2) formed by appropriate conduits to at least one radiator for cooling a coolant and to circuits for cooling a cylinder block (4) and for cooling cylinder heads (4'), comprising a central module (5) in the form of a body made of thermoplastic material in which are at least partially integrated a water-circulating pump (6), a flow-regulating valve (7) disposed in said main circulating loop (2), and at least one valve (9, 9', 9") controlling supply of at least one secondary branch (10, 10', 10") forming a circulating circuit portion mounted in parallel on said main circulating loop (2) for connection to at least one heat exchanger (11, 12, 13), said central module (5) having a multi-layered tridimensional arrangement of its constituent parts.

2. Cooling unit according to claim 1, wherein said circulating pump (6) is an electrically driven pump, operation of which is controlled by an electronic management unit (6), and wherein a management and operation-monitoring unit of the vehicle provides the electronic management unit (6') with information concerning at least one of temperature of the cylinder block and of the cylinder heads, engine speed arid load, running parameters of the vehicle and reference values and measured values of thermal parameters in regions of a body of the vehicle.

3. Cooling unit according to claim 1, wherein the central module (5) further comprises at least one flow-regulating valve (8) mounted in a portion of the circulating loop (2) extending between the water-circulating pump (6) and at least one of the cylinder head cooling circuit (4') and the cylinder block cooling circuit (4).

4. Cooling unit according to claim 3, wherein there is also integrated in the structure of the central module (5) at least the casing of a liquid/gas heat exchanger (13) connected to a unit heater.

5. Cooling unit according to claim 4, wherein there is also integrated in the structure of the central module (5) connecting fittings (13) for said liquid/gas heat exchanger (13).

6. Cooling unit according to claim 3, wherein said main circulating loop (2) also comprises an additional secondary branch (15) supplying a second radiator (15') connected to a fan (15") for heating a body of the vehicle, and said secondary branch (15) being mounted in parallel on a portion of the circulating loop (2) incorporating the cooling radiator (3), with a branch upstream of the flow-regulating valve (7) connected to said radiator (3).

7. Cooling unit according to claim 3, wherein the central module (5) incorporates portions of said conduit of the main circulating loop (2), that connect elements (6, 14, 11, 12, 13) forming part of the central module (5), and said central module (5) further incorporates at least one of: in the form of connecting fittings, beginnings of remaining portions of said main circulating loop (2), beginnings of at least one of the ramification(s) forming at least one secondary branch (10, 10', 10") forming the said at least one secondary branch and beginnings of circulating circuit(s) cooled by the heat exchanger(s) (11, 12, 13).

8. Cooling unit according to claim 3, wherein said main circulating loop (2) also comprises an additional secondary branch (15) supplying a second radiator (15') connected to a fan (15") for heating a body of the vehicle, said secondary branch (15) being mounted in parallel relative to the first at least one secondary branch (10, 10' or 10').

9. Cooling unit according to claim 1, wherein there is integrated in the structure of the central module (5) at least one expansion tank (14), and at least external casings of a heat exchanger (11) for cooling exhaust gases, and of a heat exchanger (12) for cooling oil from at least one of a crankcase and automatic gearbox of the vehicle.

10. Cooling unit according to claim 9, wherein there is further integrated in the structure of the central module (5) connecting fittings (11', 12) of said heat exchangers (11, 12), and a site for fitting a filter (12").

11. Cooling unit according to claim 1, wherein there are integrated in the structure of the central module (5), at least one of: installation sites, portions of walls constituting the body, the circulating pump (6), the regulating valve(s) (7, 8), the valve(s) (9, 9', 9") controlling supply of said at least one secondary branch (10, 10', 10"), and an oil filter (12").

12. Cooling unit according to claim 1, wherein the central module (5) is formed of at least two parts obtained by injection moulding and joined together by friction welding.

13. Cooling unit according to claim 9, wherein the central module (5) is formed of an upper part (16) and a lower part (16').

14. Cooling unit according to claim 1, wherein the central module (5) is formed of at least two parts obtained by injection moulding and joined together by vibration welding.

15. Cooling unit according to claim 14, wherein the central module (5) is formed of an upper part (16) and a lower part (16).

16. Cooling unit according to claim 1, wherein said at least one valve (9, 9', 9"), controlling supply of said at least one secondary branch (10, 10', 10') is of the all-or-nothing type.

17. Cooling unit according to claim 16, wherein there is also integrated in the structure of the central module (5) at least the casing of a liquid/gas heat exchanger (13) connected to a unit heater.

18. Cooling unit according to claim 1, wherein said at least one heat exchanger (11, 12, 13) is a liquid/liquid heat exchanger.

19. Cooling unit according to claim 1, wherein said at least one heat exchanger (11, 12, 13) is a liquid/gas heat exchanger.

* * * * *